US005095876A

United States Patent [19]

Yonekawa et al.

[11] Patent Number: 5,095,876

[45] Date of Patent: Mar. 17, 1992

[54] FUEL SUPPLYING DEVICE FOR AN INTERNAL COMBUSTION ENGINE HAVING MULTIPLE CYLINDER

[75] Inventors: Masao Yonekawa; Hirotada Yamada; Mitsunori Takao, all of Kariya; Ryo Nagasaka, Nagoya, all of Japan

[73] Assignee: Nippondenso Co., Ltd., Kariya, Japan

[21] Appl. No.: 589,434

[22] Filed: Sep. 27, 1990

[30] Foreign Application Priority Data

Sep. 29, 1989 [JP] Japan ..... 1-255398

[51] Int. Cl.[5] ..... F02M 55/02

[52] U.S. Cl. ..... 123/468; 123/516; 123/456; 123/41.31

[58] Field of Search ..... 123/468, 469, 470, 475, 123/456, 41.31, 516, 541

[56] References Cited

U.S. PATENT DOCUMENTS

| | | | |
|---|---|---|---|
| 4,235,375 | 11/1980 | Melotti . | |
| 4,334,512 | 6/1982 | Biernath | 123/469 |
| 4,341,193 | 7/1982 | Bowler | 123/516 |
| 4,416,238 | 11/1983 | Knapp | 123/516 |
| 4,601,275 | 7/1986 | Weinand | 123/456 |
| 4,782,808 | 11/1988 | Bostick | 123/516 |
| 4,809,743 | 3/1989 | Sukimoto | 123/456 |
| 4,844,036 | 7/1989 | Bassler | 123/456 |
| 4,926,829 | 5/1990 | Tuckey | 123/41.31 |
| 4,957,085 | 9/1990 | Sverdlin | 123/41.31 |
| 4,966,120 | 10/1990 | Itoh | 123/516 |
| 5,002,030 | 3/1991 | Mahnke | 123/469 |

FOREIGN PATENT DOCUMENTS

| | | | |
|---|---|---|---|
| 63-168 | 1/1988 | Japan . | |
| 0224447 | 9/1989 | Japan | 123/541 |
| 0900045 | 1/1982 | U.S.S.R. | 123/468 |
| 2142089 | 1/1985 | United Kingdom | 123/470 |

*Primary Examiner*—Carl Stuart Miller

*Attorney, Agent, or Firm*—Cushman, Darby & Cushman

[57] ABSTRACT

The present invention relates to a fuel supplying device for an internal combustion engine having multiple cylinder. The present invention comprises a plurality of fuel injection valves, a fuel pipe through which fuel flows, and a plurality of holder means on the fuel pipe so that the fuel from the fuel pipe is supplied to the holder means. The holder means accommodates the fuel injection valve so that the fuel is supplied to the fuel injection valve, and a start timing of the fuel supplied from the fuel pipe to at least one of the holder means is different from the start timing of the fuel supplied from the fuel pipe to the remaining holder means.

6 Claims, 22 Drawing Sheets

THE OFFSET IS SET SMALL FOR ALL CYLINDERS

THE OFFSET IS SET LARGE FOR ALL CYLINDERS

THE OFFSET IS SET COMBINATION OF SMALL AND LARGE

FUEL SUPPLYING DEVICE FOR AN INTERNAL COMBUSTION ENGINE HAVING MULTIPLE CYLINDER

BACKGROUND OF THE INVENTION

This invention relates to a fuel supplying device for an internal combustion engine having multiple cylinder.

In conventional multiple cylinder internal combustion engines, a fuel supply unit (injection valve) 1 as shown in FIG. 38 is used, in which fuel is received from a fuel pipe 2 at a top portion of the injection valve and supplied to an internal combustion engine 3 from a lower portion of the injection valve. In such a structure, however, vapor (fuel vapor) is generated when the engine is restarted in a high temperature condition, making starting impossible or causing stalling or rough idling. Further, since the fuel injection valve 1 is cooled only by a small quantity of fuel flowing therethrough, the temperature of the fuel injection valve 1 lowers little. The foregoing inconveniences last for a long time.

In view of the foregoing defects, or to quickly lower the temperature of the fuel injection valve after restarting in a high temperature condition, Japanese Utility Model Laid-Open No. 63-168, for example, has proposed to introduce fuel into the fuel injection valve through the vicinity of a side face or lower portion thereof or to cause fuel flow around the fuel infection valve by providing a holder portion in a fuel pipe. Even incorporating such measures, however, stalling or rough idling continues (for a few seconds to some tens of seconds) until the temperature of the fuel injection valve lowers down to a level where no vapor is generated.

Specifically, as shown in FIGS. 39 and 40, where the minimum distance (hereinafter referred to as the offset) L between the center of a fuel flow path defined by a fuel pipe 4 and the center of a fuel injection valve 6 provided with a holder portion 5 is "zero" or very small, since a high boiling point component (liquid) of fuel remains inside the fuel pipe 4 or fuel injection valve 6 even after a low boiling point component of fuel changes into vapor because of an increase in temperature of the fuel in the fuel pipe 4 or fuel injection valve 6, restarting is possible. However, upon actuation of a fuel pump, the high boiling point component (liquid) of fuel is pushed out or the fuel just supplied generates new vapor inside the fuel pipe 4 or fuel injection valve 6 still kept in a high temperature condition; thus, stalling or rough idling occurs. On the other hand, as shown in FIGS. 41 and 42, where the offset L is large, the residual high boiling point component (liquid) of fuel is not pushed out entirely; however, since the flow of fuel does not come into direct contact with the fuel injection valve 6, the fuel injection valve is cooled very slowly. Therefore, after the high boiling point component (liquid) of fuel is consumed, vapor is generated.

SUMMARY OF THE INVENTION

It is an object of the present invention to provide a fuel supplying device for an internal combustion engine having multiple cylinder, the fuel supplying device which maintains fuel supply by means of a residual high boiling point component (liquid) of fuel to obtain a superior high temperature restarting capability.

DETAILED DESCRIPTION OF THE PREFERRED EMBODIMENTS

Figure 4:
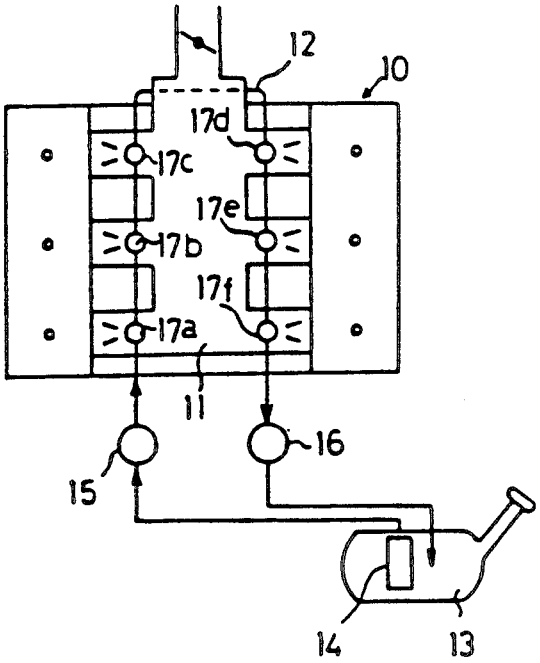
FIG. 4 is a schematic view of a first embodiment.

A first embodiment according to a first feature of the present invention will be described. FIG. 4 schematically shows the first embodiment of fuel supplying device used in a V-type six cylinder engine 10. An intake pipe 11 is connected with the V-type six cylinder engine 10 and combined with a fuel pipe 12 equipped with fuel injection valves (injectors) 17*a* to 17*f* for supplying fuel to each cylinder. The fuel supplied from a fuel tank 13 with pressure by a fuel pump 14 acting as fuel supply pump is filtered by a fuel filter 15, sent to the fuel pipe 12, and supplied to the engine 10. The remainder of fuel not consumed passes through a pressure governer 16 and returns to the fuel tank 13.

The fuel pipe 12 and its surroundings will be described in greater detail.

Figure 1:
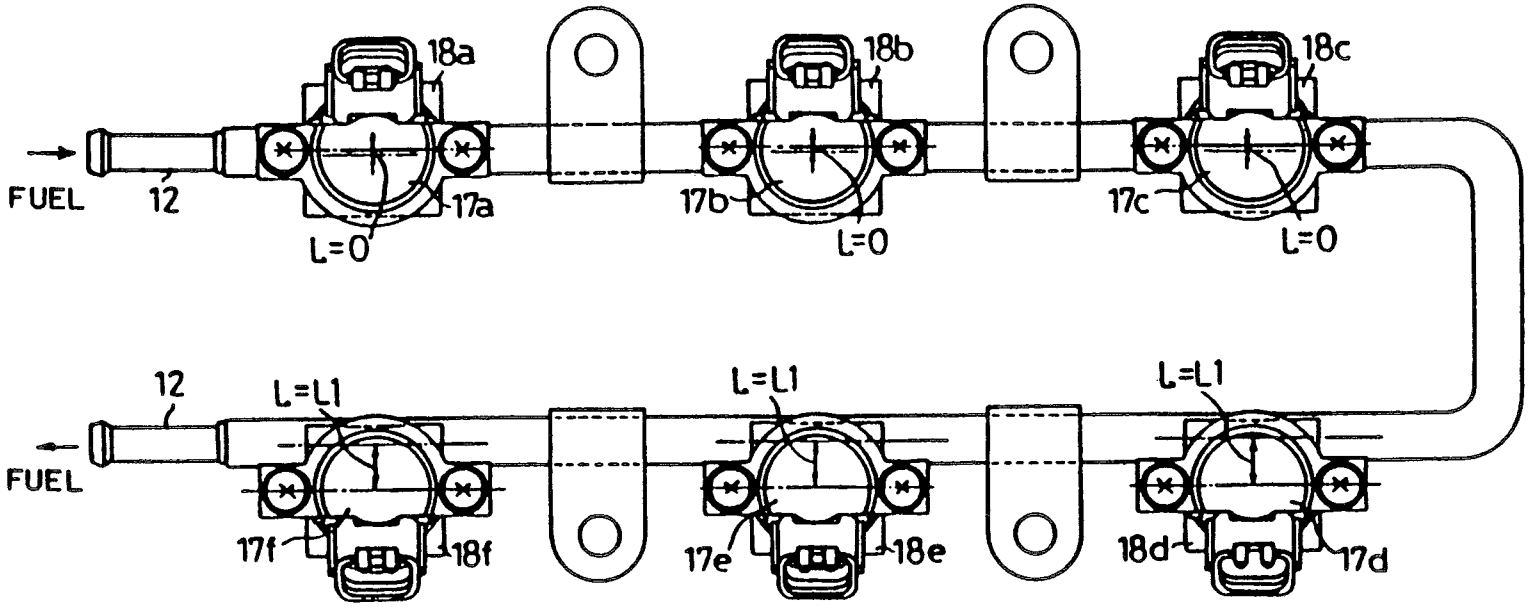
FIG. 1 is a plan view of a first embodiment.
Figure 2:
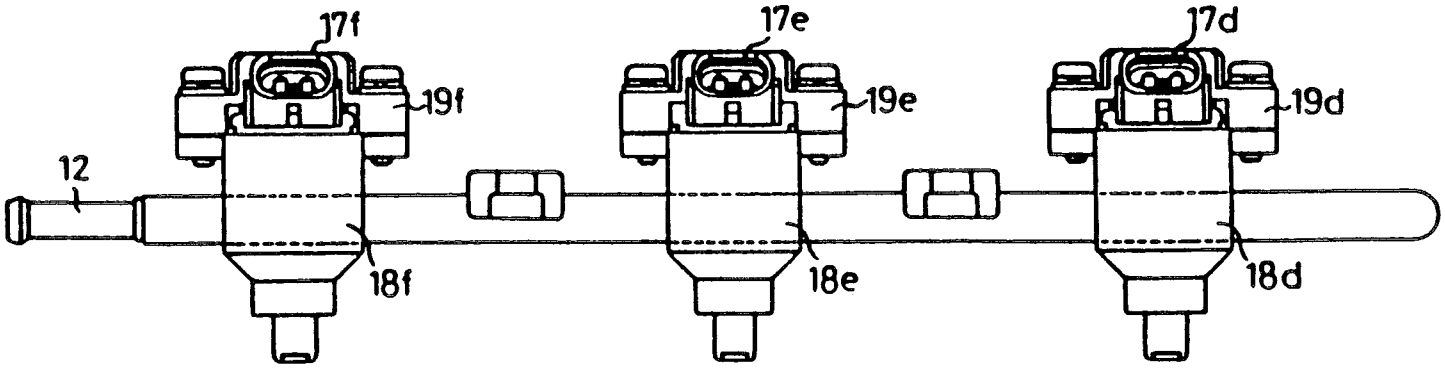
FIG. 2 is a front view of a first embodiment.
Figure 3:
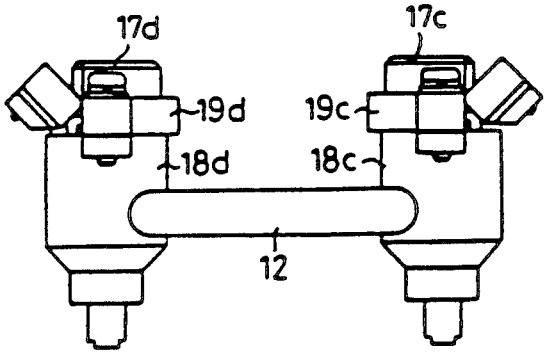
FIG. 3 is a side view of a first embodiment.
Figure 5:
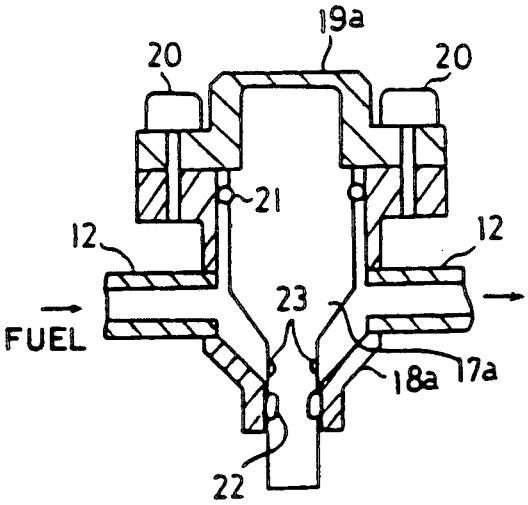
FIG. 5 is a fragmentary sectional view of a first embodiment.

As shown in FIGS. 1 to 3, holder portions 18*a* to 18*f* for accommodating the fuel injection valves 17*a* to 17*f* are attached to the fuel 12 extending from a fuel inlet to a fuel outlet. Specifically, with respect to each cylinder, as shown in FIG. 5, a retainer member 19*a* (to 19*f*) is connected and secured to the holder portion 18*a* (to 18*f*) by screws 20 such that the fuel injection valve 17*a* (to 17*f*) is accommodated in the inside of these parts. Upper and lower O-rings 21 and 22 are provided on the fuel injection valve 17*a* (to 17*f*) such that the fuel circulates through the fuel injection valve and the holder portion 18*a* (to 18*f*). The fuel injection valve 17*a* (to 17*f*) receives the fuel through feed holes 23.

With respect to the holder portions 18*a* to 18*c* for the three cylinders arranged in the fuel inlet section of the fuel pipe 12, the center of each of the fuel injection valves 17*a* to 17*c* is in accord with the center of the fuel pipe 12 (the offset L=0). On the contrary, with respect to the holder portions 18*d* to 18*f* for the three cylinders arranged in the fuel outlet section of the fuel pipe 12, the distance between the center of each of the fuel pipe 12 is large (the offset L=L1).

The operation of the foregoing fuel supply device will be described.

When the engine 10 is stopped after it is operated for a long time in heavy load condition, the temperature of an engine room rises, and the fuel pipe 12 also becomes a high temperature condition. At this time, a low boiling point component of fuel changes into vapor. Although the fuel still in a liquid state together with the generated vapor flows out of the pressure governer 16 due to the pressure of the vapor, a part of a high boiling point component (liquid) of fuel remains inside the fuel injection valves 17*a* to 17*f* and/or the holder portions 18*a* to 18*f*. If the engine 10 is restarted in this condition, the engine 10 can restart by means of the residual high boiling point component (liquid) of fuel. Then, upon actuation of the fuel pump 14, the cold fuel in the fuel tank 13 is sent out therefrom.

Figure 6:
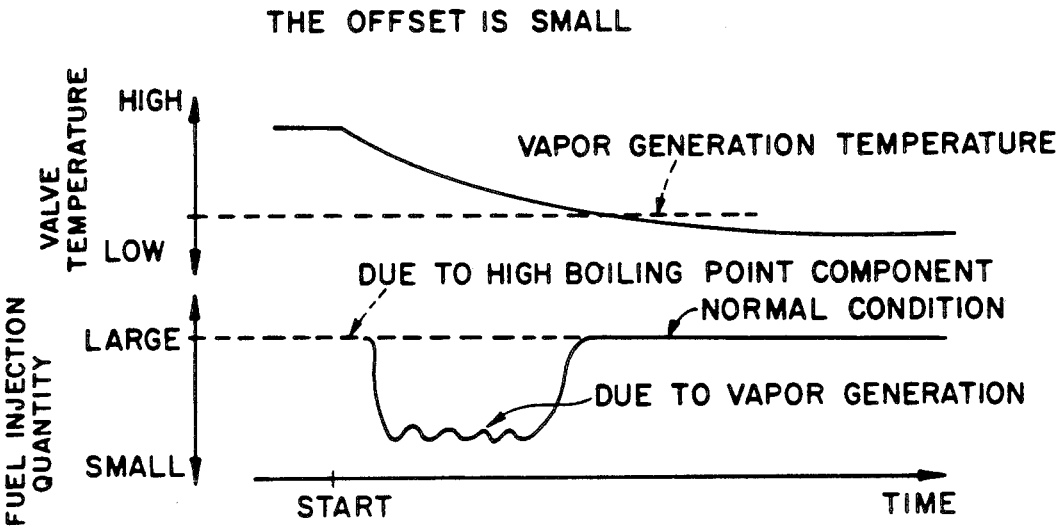
FIGS. 6 to 10 are time charts explanatory of the operation of a fuel supply device at the time of restarting.
Figure 8:
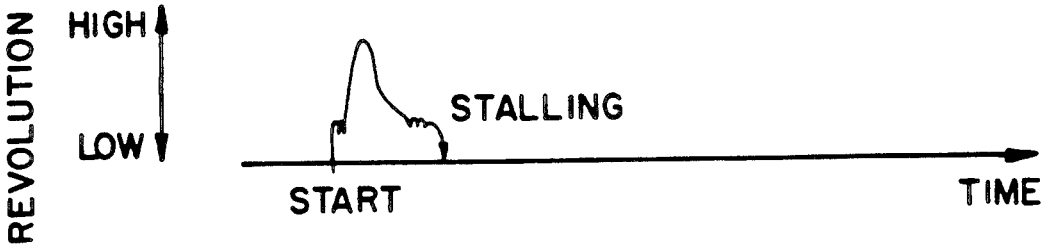

The cold fuel passing through the fuel inlet section of the fuel pipe 12 comes into direct contact with the fuel injection valves 17*a* to 17*c* for the three cylinders arranged in the inlet section to quickly cool the fuel injection valves 17*a* to 17*c*. However, the residual high boiling point component (liquid) of fuel flows out of the holder portions 18*a* to 18*c* for the first three cylinders, and the following fuel just supplied becomes high in temperature, generating vapor (FIG. 6). Here, if the offset L is set small for all the six cylinders, stalling and/or rough idling occurs as shown in FIG. 8.

Figure 7:
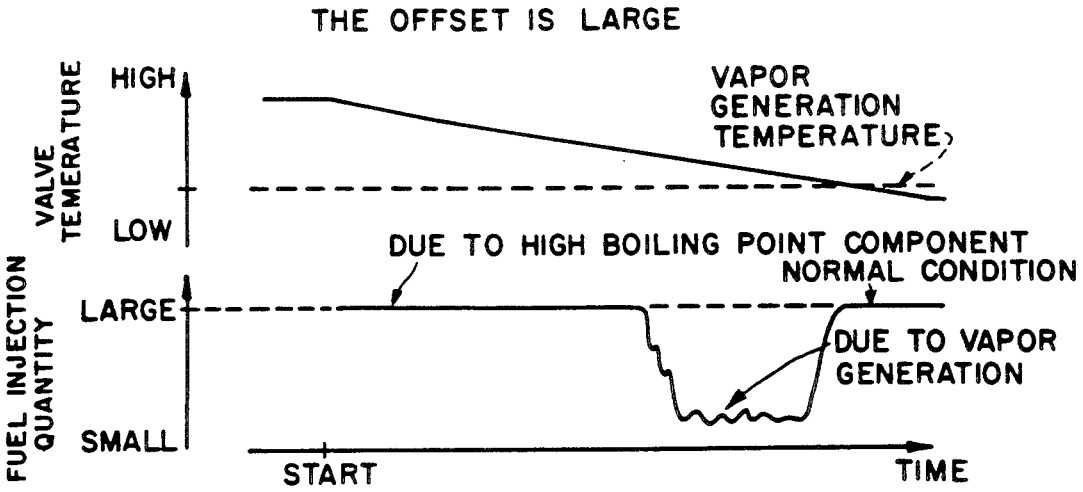
Figure 9:
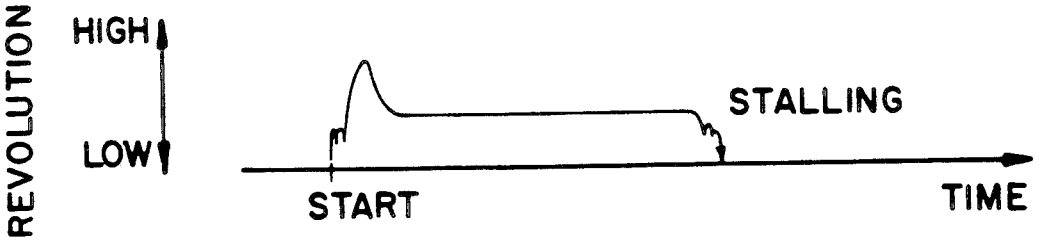
Figure 10:
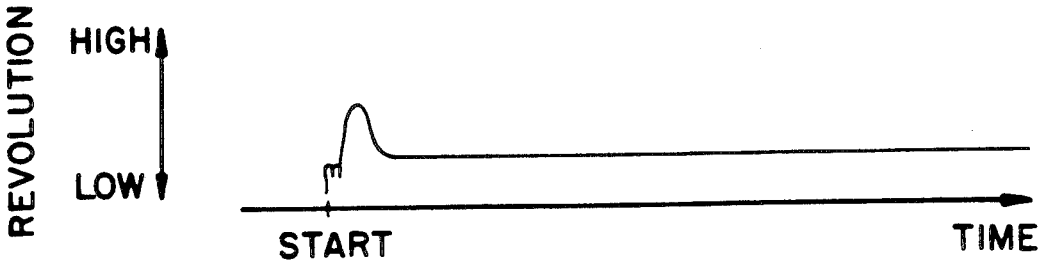

On the other hand, the fuel injection valves 17*d* to 17*f* for the three cylinders arranged in the outlet section of the fuel pipe 12 are large in offset L such that the fuel does not come into direct contact with these valves, and thus, the residual high boiling point component (liquid) of fuel still remains there; therefore, the engine 10 can be supplied with fuel while the residual high boiling point component (liquid) is in existence. After a while, the residual high boiling point component relative to the three cylinders arranged in the outlet section o the fuel pipe 12 is consumed entirely: as a result, vapor is generated (FIG. 7) because the fuel injection valves 17*d* to 17*f* are not sufficiently cooled yet. Here, if the offset L is set large for all the six cylinders, stalling and/or rough idling occurs as shown in FIG. 9. In this embodiment, however, since the temperature of the fuel injection valves 17*a* to 17*c* for the three cylinders arranged in the inlet section becomes fairly lower than a vapor generation temperature at this time, there is no problem in relation to fuel supply. In this way, a high temperature restarting capability free of stalling can be ensured (FIG. 10).

The reason why the offset L of each fuel injection valve (17*a* to 17*c*) arranged in the fuel inlet section of the fuel pipe 12 is set small (L=0) is that the fuel injection valves arranged in the fuel inlet section are effectively and quickly cooled more than the others by the new fuel supplied from the fuel tank 13 because the temperature of the new fuel rises simply as it passes inside the fuel pipe 12.

As described above, in this embodiment, the minimum distance (offset L) between the center of the pipe 12 (acting as fuel flow path and coupled with the holder portions 18*a* to 18*f*) and the center of each of the fuel injection valves 17*a* to 17*f* is changed from cylinder to cylinder such that the cylinders are divided into two groups in terms of the offset, or that the fuel injection valves 17*a* to 17*c* of the multiple cylinder internal combustion engine are quickly cooled and remaining cylinders (corresponding to the fuel injection valves 17*d* to 17*f*) utilize the residual high boiling point component (liquid) of fuel to maintain fuel supply, whereby fuel supply can be maintained to obtain a superior high temperature restarting capability.

Modifications of this embodiment will be described.

Although this embodiment is configured such that the offset L of each of the holder portions 18*a* to 18*c* for the three cylinders arranged in the fuel inlet section of the fuel pipe 12 is made zero, it is not necessarily set to zero. It is sufficient to set the offset relative to the fuel inlet section of the fuel pipe 12 fairly smaller than that in the fuel outlet section.

Figure 11:
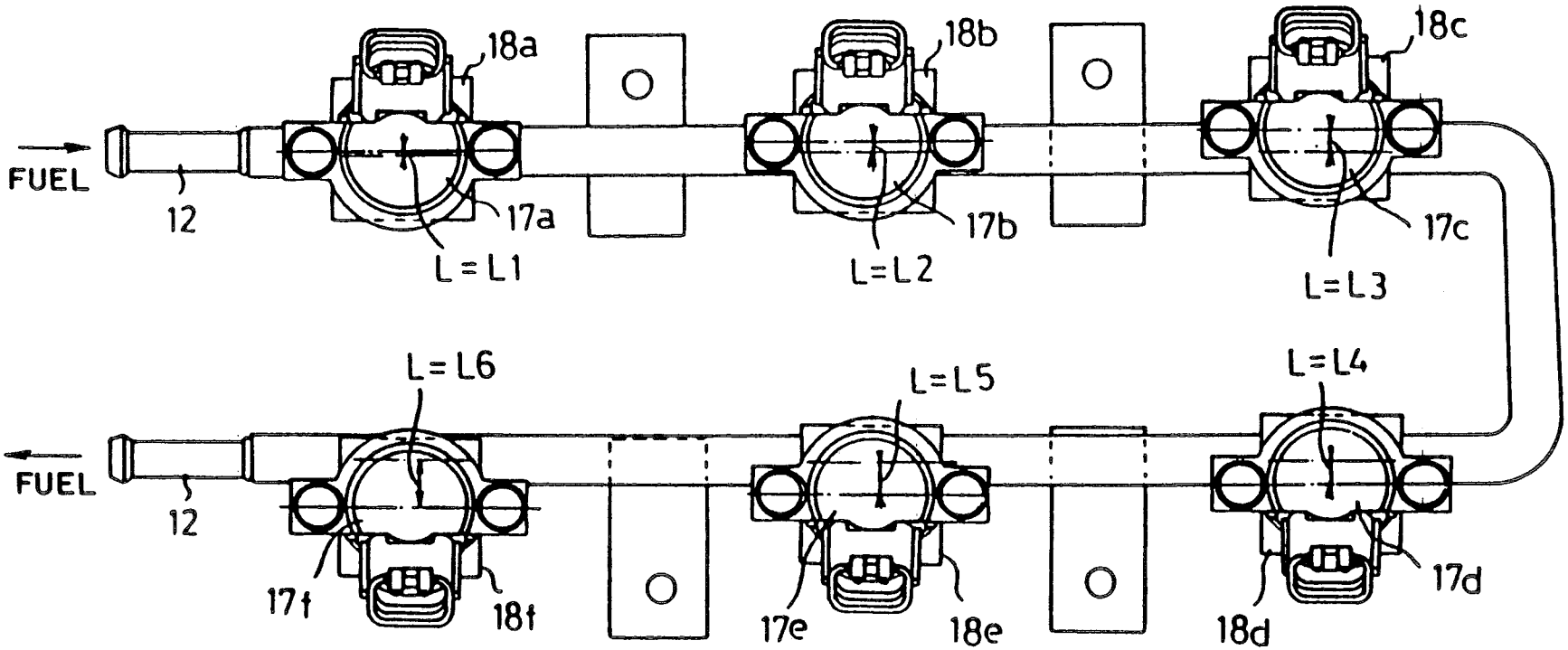
FIGS. 11 to 16 are plan views showing modification of the first embodiment.

Although this embodiment uses two kinds of offset (L=0 and L=L1), the offset L may be increased from cylinder to cylinder progressively in the flow direction of fuel (L1<L2<L3<L4<L5<L6) as shown in FIG. 11. In this case, the fuel injection valves are differentiated in operation mode from one another such that the fuel injection valve 17*a* is quickly cooled and the fuel injection valve 17*f* supplies much fuel by means of the residual high boiling point component of fuel. That is, the moment when the supply amount of fuel decreases is shifted from cylinder to cylinder, whereby continuity in smooth revolution can be expected.

Figure 12:
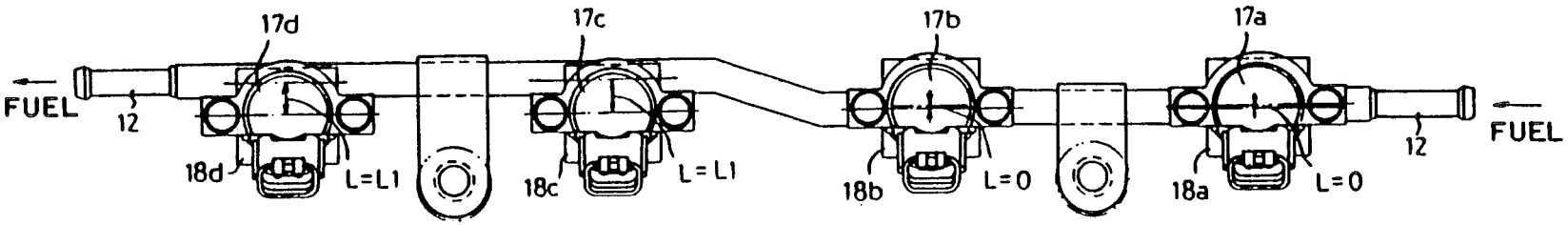
Figure 13:
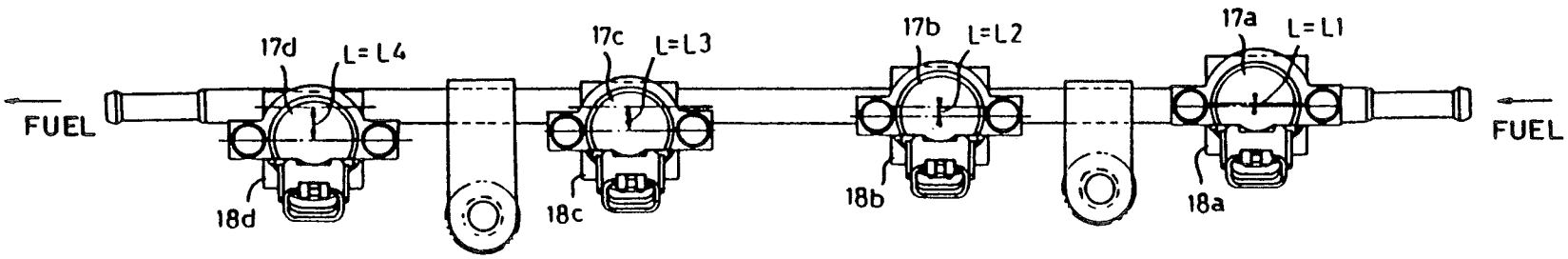

This embodiment can be applied to a serial four cylinder engine as shown in FIG. 12. In this case, the serial four cylinder engine uses two kinds of offset (L=0 and L-L1). Further, as shown in FIG. 13, the offset L may be changed from cylinder to cylinder progressively in the flow direction of fuel (L1<L2<L3<L4).

FIG. 10 shows a V-type six cylinder engine in which the fuel pipe 12 is divided at the fuel inlet end into two paths which are united at the fuel outlet end. In this case, each pipe path of the pipe 12 is provided with the holder portions, the offset L of the upper pipe path is set to zero (L=0), and the offset L of the lower pipe path is made large (L=L1). When the engine is restarted in a high temperature condition, the fuel flowing through the upper pipe path comes into direct contact with the fuel injection valves 17*a* to 17*c* to quickly cool them. On the other hand, the fuel in the lower pipe path flows beside the fuel injection valves 17*d* to 17*f* whereby the fuel injection valves 17*d* to 17*f* of the lower pipe path can supply the high boiling point component (liquid) of fuel to the engine for a long time.

Figure 15:
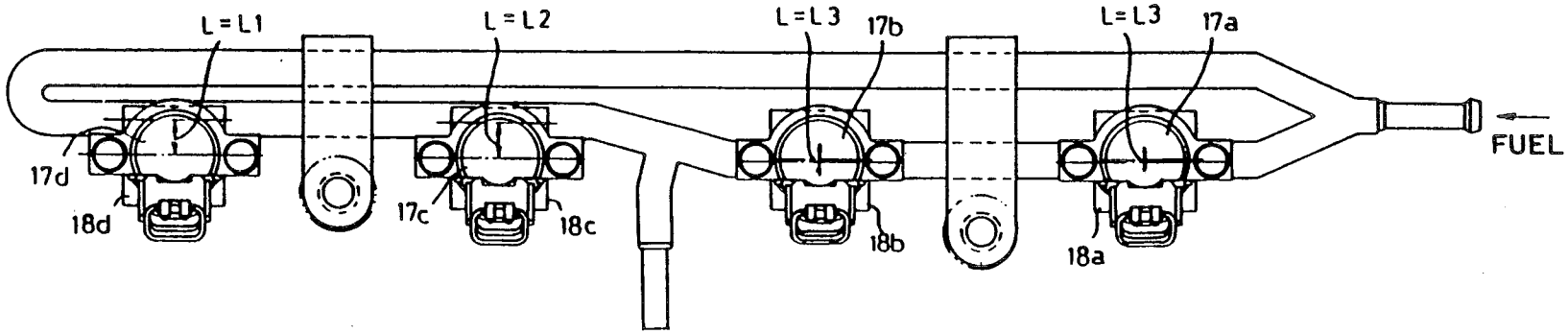

FIG. 15 shows a serial four cylinder engine in which the fuel pipe 12 defines parallel pipe paths (which are united at the inlet end and outlet end).

Figure 14:
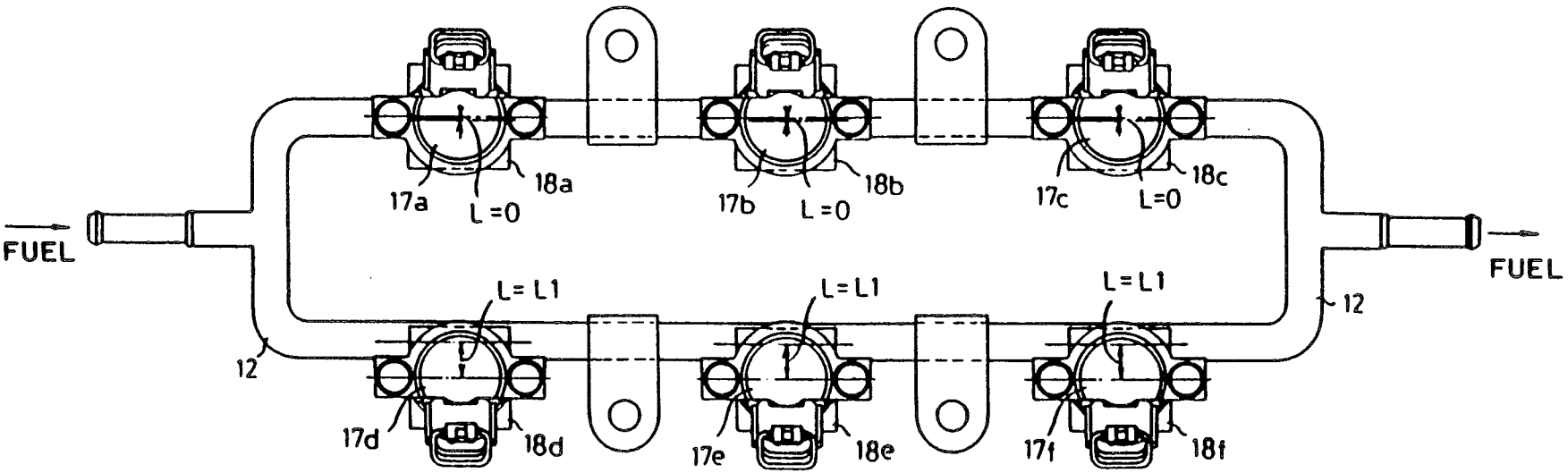

In the parallel type of piping as shown in FIG. 14 and 15, also, the offset L may be changed from cylinder to cylinder progressively. Specifically;, the offset L of one pipe path 12 may be increased "from small to medium" in the flow direction of fuel, and the offset L of the other pipe path 12 may be increased "from medium to large" in the flow direction of fuel.

Further, this embodiment can be applied to an engine in which the fuel pipe 12 is divided into three or more parallel pipe paths.

Figure 16:
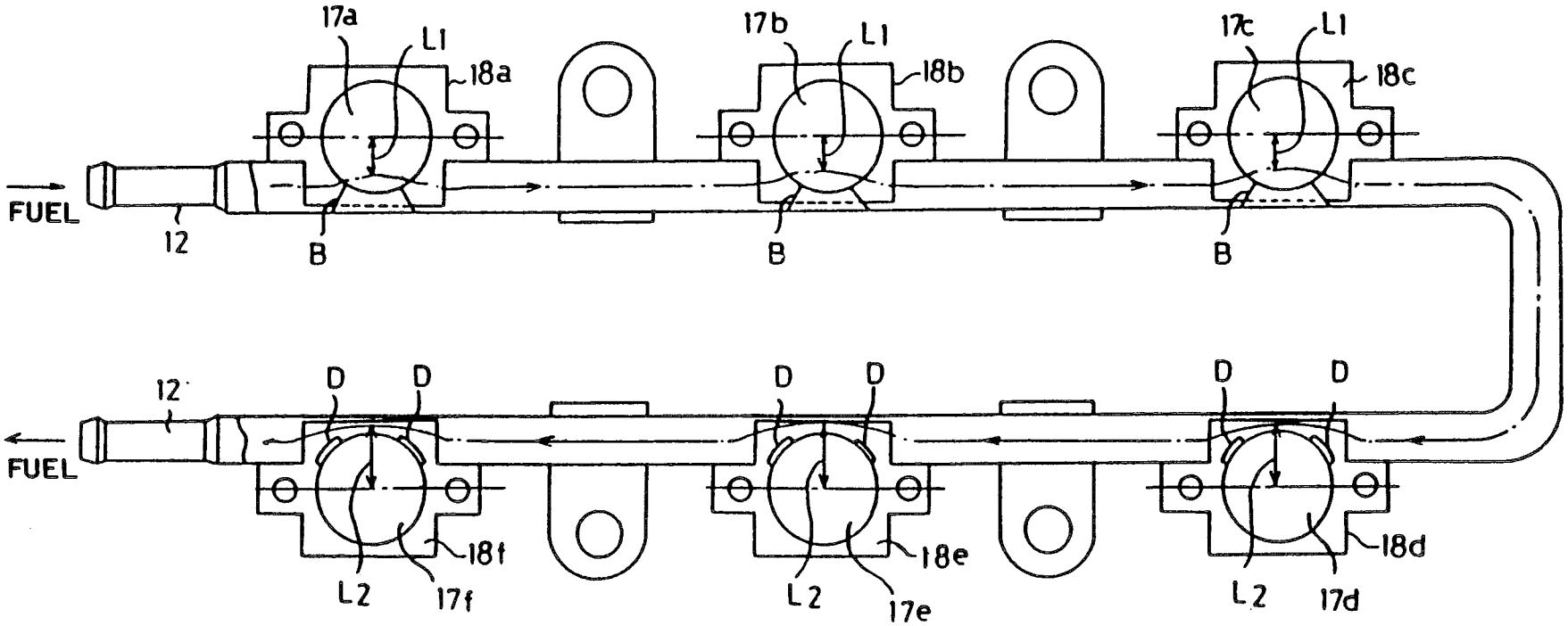

FIG. 16 shows a V-type six cylinder engine in which a bulge portion B or a partition portion D for changing the flow path of fuel is provided inside each of the holder portions 18*a* to 18*f* to change the offset L from cylinder to cylinder. In this engine, the minimum distance (offset) between the center of the fuel flow path defined by the fuel pipe 12 and the center of each of the fuel injection valves 17*a* to 17*c* for the upper three cylinders is set to L1 by the bulge portion B, and the minimum distance (offset) between the center of the fuel flow path defined by the fuel pipe 12 and the center of each of the fuel injection valves 17*d* to 17*f* is set to L2 (>L1) by the partition portion D.

In this way, the present invention can be applied to any multiple cylinder engine irrespective of the type of engine, the number of cylinders, the kind of piping, the manner of setting the offset, L, etc.

A second embodiment according to a second feature of the present invention will be described.

Figure 17:
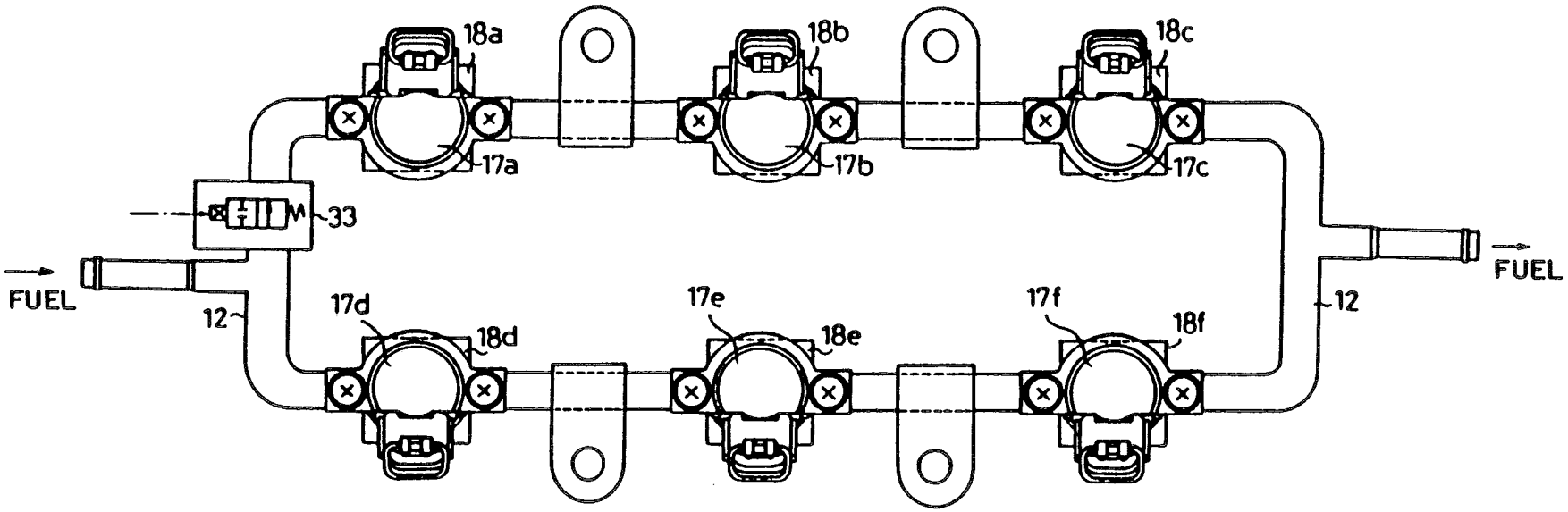
FIG. 17 is a plan view of a second embodiment.

FIG. 17 shows the second embodiment of the fuel supply device used in a V-type six cylinder engine. In FIG. 17, parts identical with those shown in FIGS. 1 to 5 are designated by the same reference numerals, with their description omitted.

One pipe section with the holder portions 18*a* to 18*c* and the other pipe section with the holder portions 18*d* to 18*f* are connected in parallel, and an electromagnetic valve 33 is provided at the inlet end of the pipe section including the holder portion 18*a* to 18*c*. When in a nonenergized condition, the electromagnetic valve 33 is in an open state, so that an equal amount of fuel flows through both the one pipe section including the holder portions 18*a* to 18*c* and the other pipe section including the holder portions 18*d* to 18*f*. When in an energized condition, the electromagnetic valve 33 is in a closed state, so that no fuel flows through the one pipe section including the holder portions 18*a* to 18*c*.

The operation of the foregoing fuel supply device will be described.

When the engine 10 is stopped after it is operated for a long time in a heavy load condition, the temperature of the engine room rises, and the fuel pipe 12 also becomes a high temperature condition. At this time, the low boiling point component of fuel changes into vapor and flows out of the pressure governer 16. But, a part of the high boiling point component (liquid) of fuel remains inside the fuel injection valves 17*a* to 17*f* and/or the holder portions 18*a* to 18*f*. In this case, the electromagnetic valve 33 is in the open state.

Then, if the engine 10 is restarted in this condition, the electromagnetic valve 33 is closed. Upon restarting, the engine 10 can restart because of the presence of the residual high boiling point component (liquid) of fuel. Then, because the electromagnetic valve 33 is in the closed state, no flow of fuel is formed in the pipe section including the holder portions 18*a* to 18*c* even after the fuel pump 14 is actuated, so that the high boiling point component (liquid) of fuel remains there. Therefore, the engine 10 can be supplied with fuel while the residual high boiling point component (liquid) of fuel is in existence.

After a while, the residual high boiling point component in the pipe section including the holder portions 18*a* to 18*c* is consumed entirely. However, the fuel injection valves 17*d* to 17*f* of the pipe section including the holder portions 18*d* to 18*f* are cooled by the cold fuel sent from the fuel tank 13 upon actuation of the fuel pump 14; as a result, the temperature of these valves becomes fairly lower than a vapor generation temperature; therefore, there is no problem in relation to subsequent fuel supply.

The electromagnetic valve 33 is designed to be closed for a given time after the engine 10 is started in a high temperature condition and to be opened thereafter.

As described above, in this embodiment, the pipe including the holder portions 18*a* to 18*f* is divided into the two parallel pipe sections including the holder portions 18*a* to 18*c* and the holder portions 18*d* to 18*f*, the electromagnetic valve 33 is provided which opens for a given time at the time of high temperature starting, and one of the two parallel pipe sections is blocked by the electromagnetic valve 33 as to prevent fuel flowing. Accordingly, the cylinders of the multiple cylinder internal combustion engine are divided into two groups, that is, the fuel injection valves 17*d* to 17*f* are quickly cooled and the remaining cylinders (corresponding to the fuel injection valves 17*a* to 17*c*) utilize the residual high boiling point component (liquid) of fuel to maintain fuel supply, whereby a high temperature restarting capability free of stalling can be ensured.

Although the electromagnetic valve 33 of this embodiment is used to prevent fuel from flowing through on of the two parallel pipe sections, the electromagnetic valve 33 may be controlled in terms of a duty factor such that the flow rate of each of the two parallel pipe sections is varied, or that the difference in flow rate between them is varied to change the discharge efficiency of the residual high boiling point component (liquid) of fuel and the efficiency of cooling.

A third embodiment according to a third feature of the present invention will be described.

Figure 18:
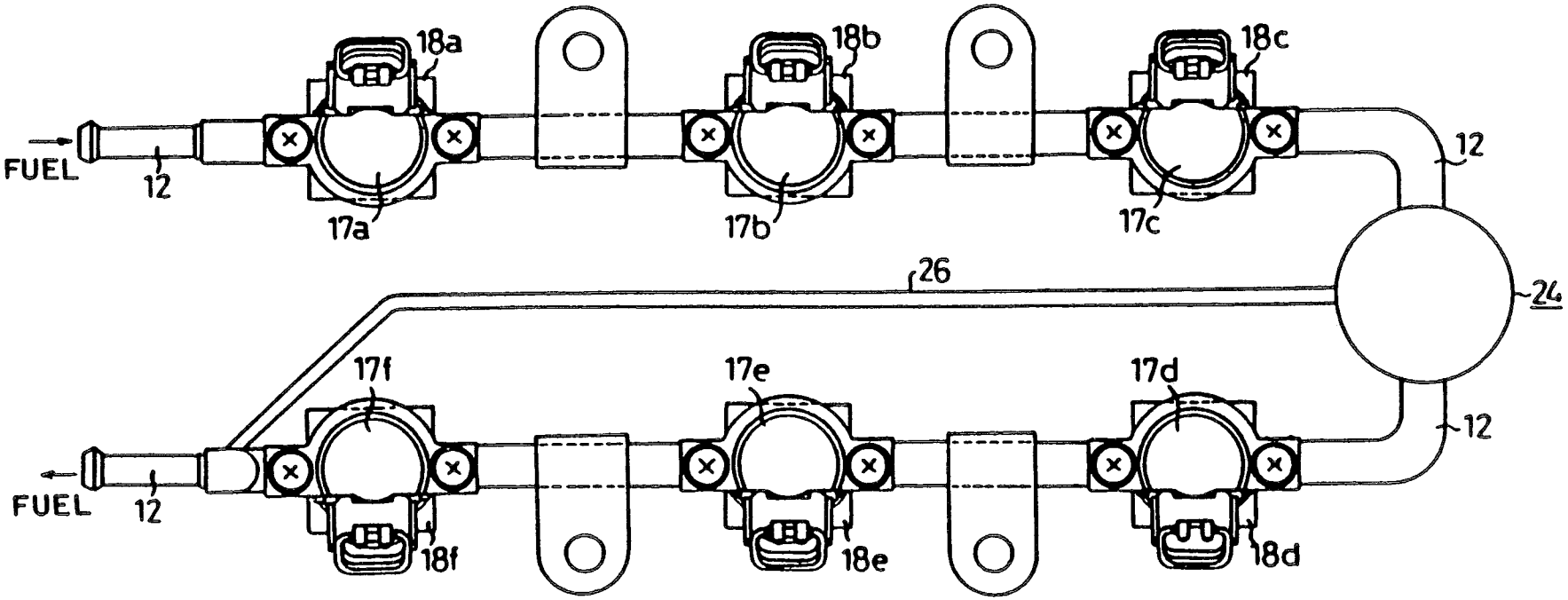
FIG. 18 is a plan view of a third embodiment.
Figure 19:
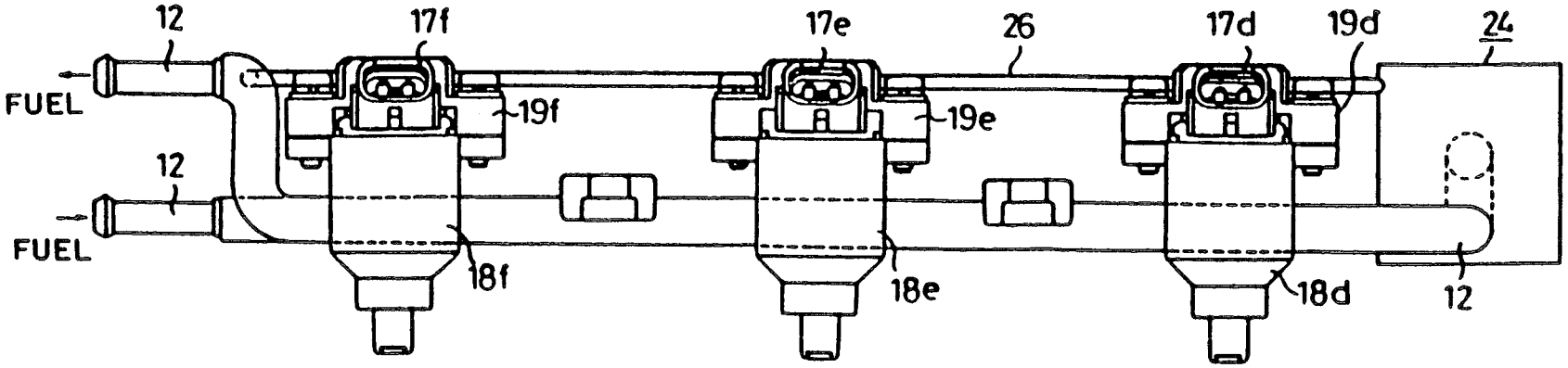
FIG. 19 is a front view of a third embodiment.
Figure 20:
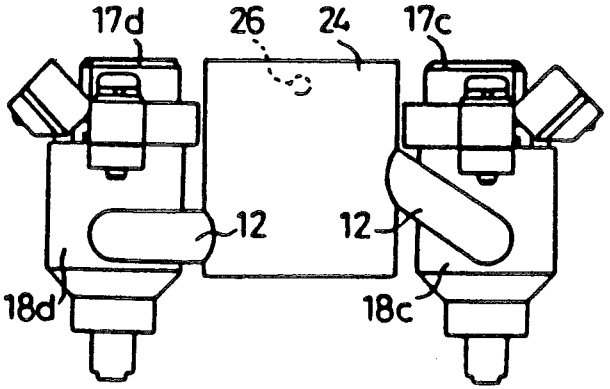
FIG. 20 is a side view of a third embodiment.

FIGS. 18 to 20 show the third embodiment of the fuel supply device used in a V-type six cylinder engine. In these drawings, parts identical with those shown in FIGS. 1 to 5 are designated by the same reference numerals, with their description omitted.

Figure 21:
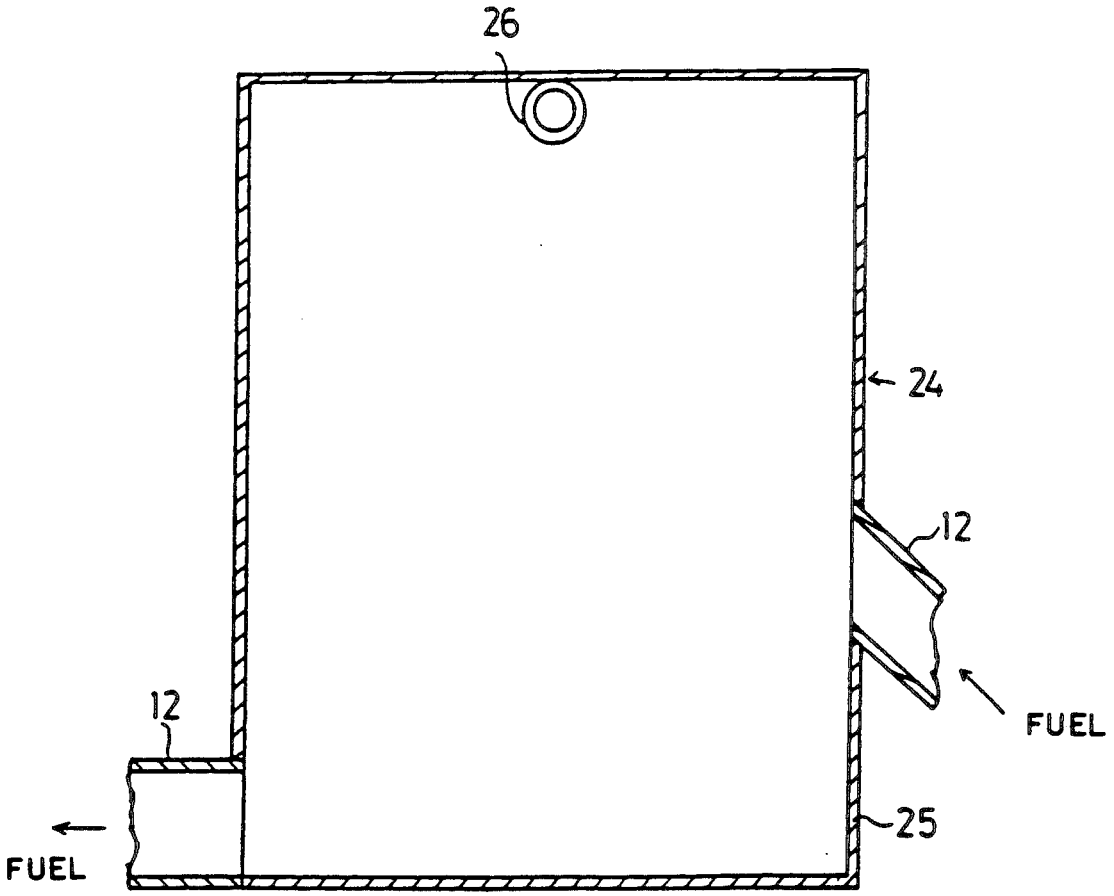
FIG. 21 is a sectional view of a tank.

A tank 24 for temporarily storing fuel is provided at the midpoint of the fuel pipe of the holder portions 18*a* to 18*f* or between the holder portions 18*c* and 18*d*. As shown in FIG. 21, the tank 24 comprises a cylindrical tank body 25 whose lateral lower portion is connected with a fuel pipe section 12 leading to the holder portion 18*d* on the downstream side and whose lateral upper portion is connected with another fuel pipe section 12 leading to the holder portion 18*c* on the upstream side. Further, a top portion of the tank body 25 is connected with a vapor pipe 26 for taking fuel vapor out of the tank 25, with the other end of the vapor pipe 26 being connected with a fuel pipe section 12 connected to the downstream end of the last holder portion 18*f* (see FIG. 18).

The operation of the foregoing fuel supply device will be described.

When the engine 10 is stopped after it is operated for a long time in a heavy load condition, the temperature of the engine room rises, and the fuel pipe 12 also becomes a hign temperature condition. At this time, the low boiling point component of fuel changes into vapor, and together with the fuel in the liquid state, the thus generated vapor flows out of the fuel injection valves 17*a* to 17*f* by virtue of its pressure. At this time, the fuel in the fuel injection valves 17*a* to 17*c* flows into the tank 24. The hign boiling point component (liquid) of fuel is accumulated in the tank 24, whereas the low boiling point component in the form of vapor is sent through th vapor pipe 26 to the fuel pipe section 12 at the downstream end.

Then, if the engine 10 is restarted in this condition, the fuel is sent from the fuel tank 13 upon actuation of the fuel pump 14, and the residual high boiling point component (liquid) of fuel in the tank 24 is supplied to the fuel injection valves 17*d* to 17*f* on the downstream side of the tank 24. Thus, the engine 10 can be supplied with fuel by means of the residual high boiling point component (liquid) of fuel. Accordingly, the engine 10 can be supplied with fuel while the residual high boiling point component (liquid) of fuel is in existence.

After a while, the residual hign boiling point component in the tank 24 is consumed entirely. However, the fuel injection valves 17*a* to 17*c* for the three cylinders arranged in the inlet section of the fuel pipe 12 are cooled by the cold fuel sent from the fuel tank 13 upon actuation of the fuel pump 14; as a result, the temperature of these valves becomes fairly lower than a vapor generation temperature; therefore, there is no problem in relation to subsequent fuel supply.

In this way, a nigh temperature restarting capability free of stalling can be ensured.

As described above, in this embodiment, the tank 24 for storing fuel is provided midway along the pipe with the holder portions 18*a* to 18*f* for the cylinders, the vapor pipe 26 for taking fuel vapor out of the tank 24 is connected to the downstream end of the tank 24, and thus, the residual high boiling point component (liquid) of fuel is accumulated in the tank 24, whereby fuel supply can be maintained by means of the residual high boiling point component (liquid). Therefore, a superior high temperature restarting capability can be obtained.

Figure 22:
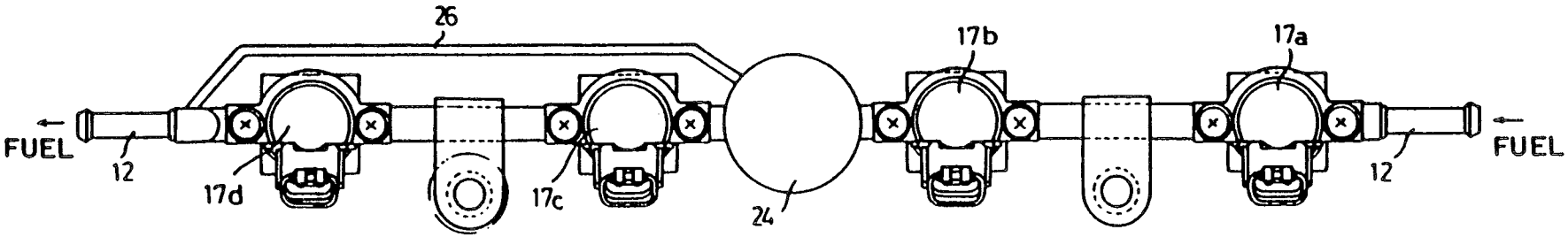
FIG. 22 is a plan view showing a modification.
Figure 23:
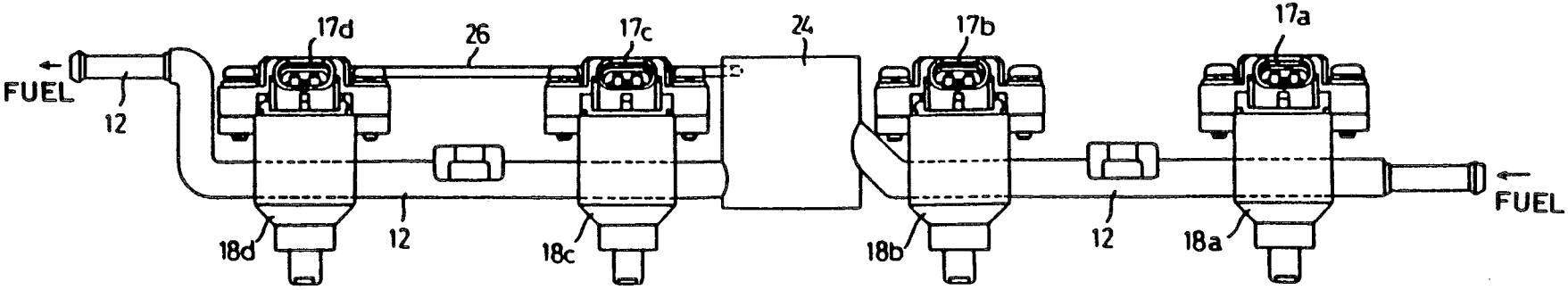
FIG. 23 is a front view showing a modification.

This embodiment can be applied to a serial four cylinder engine as shown in FIGS. 22 and 23. In this case, the tank 24 is disposed between two groups of two cylinders each, and the vapor pipe 26 is connected to the downstream end of the tank 24.

A fourth embodiment according to a fourth feature of the present invention will be described.

Figure 24:
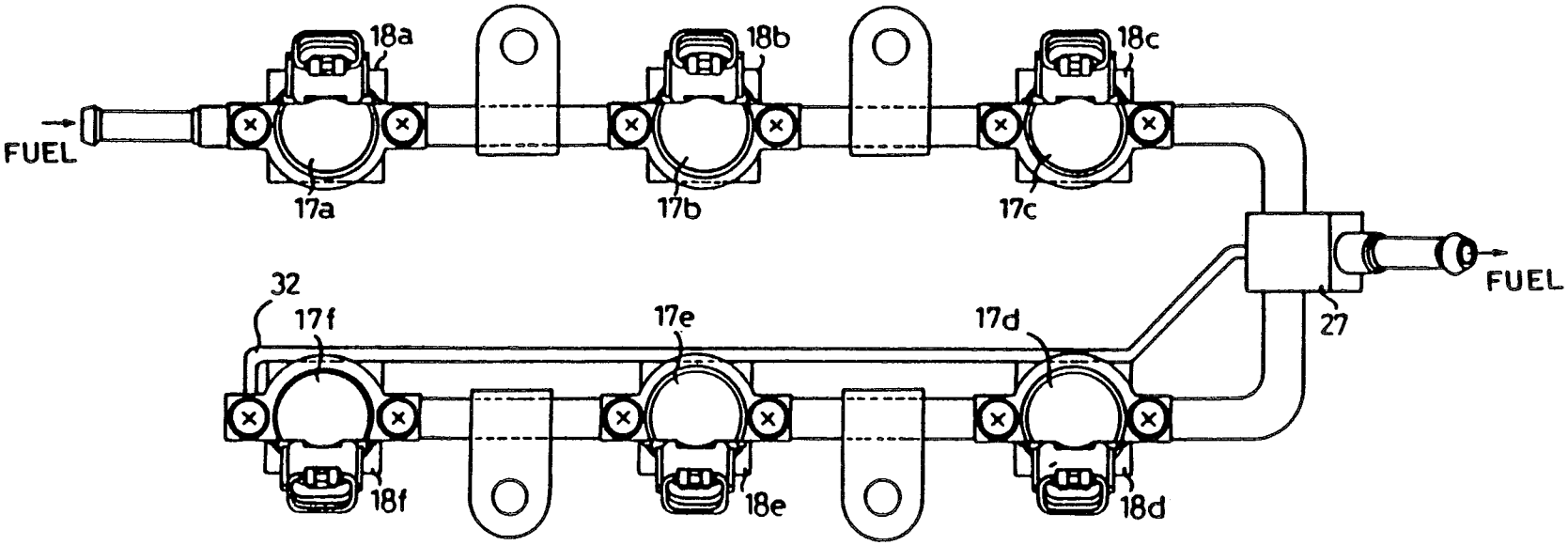
FIG. 24 is a plan view of a fourth embodiment.
Figure 25:
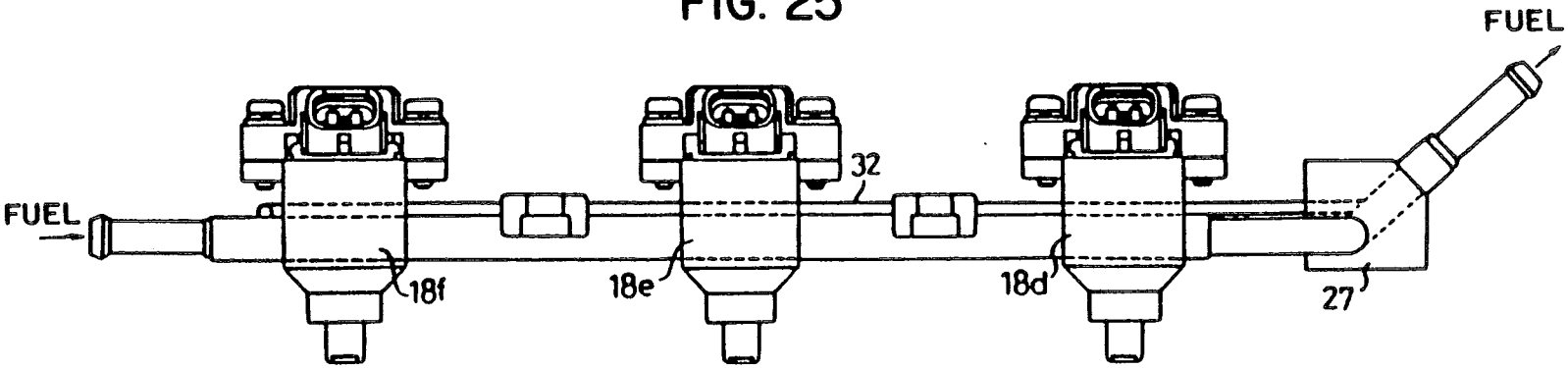
FIG. 25 is a front view of a fourth embodiment.
Figure 26:
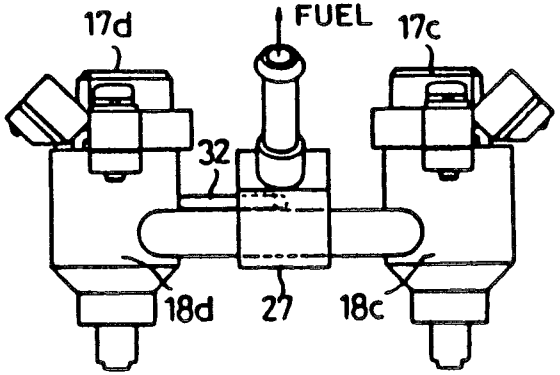
FIG. 26 is a side view of a fourth embodiment.

FIGS. 24 to 26 show the fourth embodiment of the fuel supply device used in a V-type six cylinder engine. In these drawings, parts identical with those shown in FIGS. 1 to 5 are designated by the same reference numerals, with their description omitted.

Figure 29:
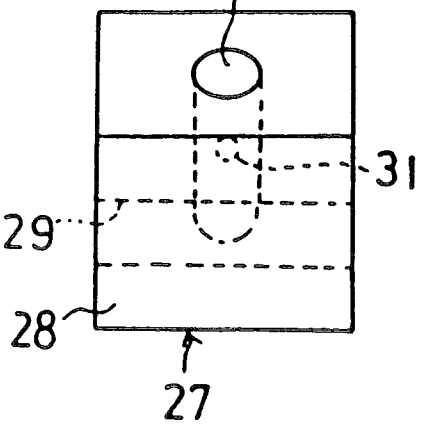
FIG. 29 is a side view of a flow divider.
Figure 28:
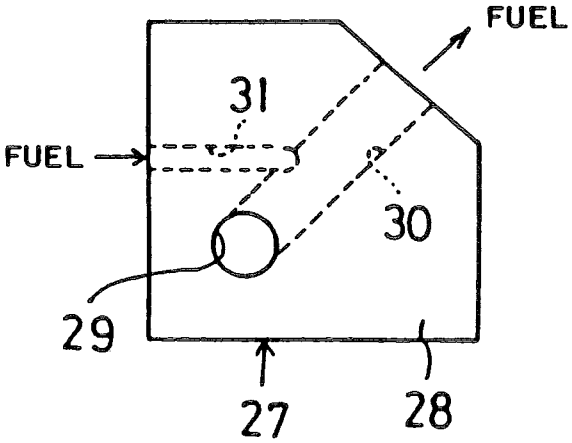
FIG. 28 is a front view of a flow divider.
Figure 27:
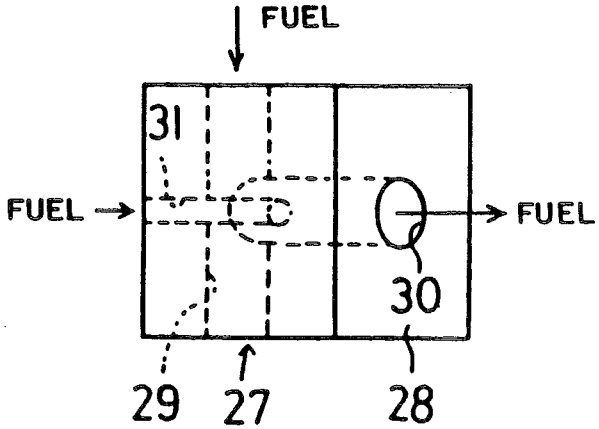
FIG. 27 is a plan view of a flow divider

A flow divider 27 is provided between the holder portions 18*c* and 18*d*, and no pipe is provided after the fuel injection valve 17*f*. As shown in FIGS. 27 to 29, the flow divider 27 comprises a housing member 28 in which a first through hole 29 is formed in the horizontal direction for communicating a fuel pipe section 12 leading to the holder portion 18*c* with another fuel pipe section 12 leading to the holder portion 18*d*. Further, a second through hole 30 for returning fuel to the fuel tank 13 is formed as to extend obliquely upward from a middle portion of the first through hole 29. Further, a third through path 31 is formed as to middle portion of the second through hole 30. The third through path 31 of the flow divider 27 is connected through a vapor pipe 32 to the holder portion 18*f* of the fuel injection valve 17*f*.

Therefore, the fuel pipe section 12 for the fuel injection valves 17*a* to 17*c* defines a circulation pipe path through which fuel circulates upon actuation of the fuel pump 14, whereas the fuel pipe section 12 for the fuel injection valves 17*d* to 17*f* defines a so-called closed pipe path through which no fuel circulates even if the fuel pump 14 is actuated. Fuel vapor can be taken out of the closed pipe path by means of the vapor pipe 32.

The operation of the foregoing fuel supply device will be described.

When the engine 10 is stopped after it is operated for a long time in a heavy load condition, the temperature of the engine room rises, and the fuel pipe 12 also becomes a high temperature condition. At this time, the low boiling point component of fuel in the closed pipe path (for the fuel injection valves 17*d* to 17*f*) changes into vapor, and the thus generated vapor is sent through the vapor pipe 32 to the downstream end of the flow divider 27. As a result, the high boiling point component (liquid) of fuel is accumulated in the closed pipe path.

Then, if the engine 10 is restarted in this condition, the engine 10 is supplied with fuel by means of the residual high boiling point component (liquid) of fuel in the closed pipe path. That is, the engine 10 can be supplied with fuel while the residual high boiling point component (liquid) of fuel is in existence.

After a while, the residual high boiling point component (liquid) of fuel in the closed pipe path is consumed entirely. However, the fuel injection valves 17*a* to 17*c* are cooled by the cold fuel sent from the fuel tank 13 upon actuation of the fuel pump 14; as a result, the temperature of these valves becomes fairly lower than a vapor generation temperature; therefore, there is no problem in relation to fuel supply.

In this way, a high temperature restarting capability free of stalling can be ensured.

As described above, in this embodiment, the closed pipe path including the holder portions 18*d* to 18*f* is branched from the circulation pipe path including the holder portions 18*a* to 18*c*, and the vapor pipe 32 for taking fuel vapor out of the closed pipe path is connected on the downstream side of the branch section (the branch portion of the flow divider 27). Accordingly, the residual high boiling point component (liquid) of fuel is accumulated in the closed pipe path, whereby fuel supply can be maintained by means of the residual high boiling point component (liquid). Therefore, a superior high temperature restarting capability can be obtained.

Figure 30:
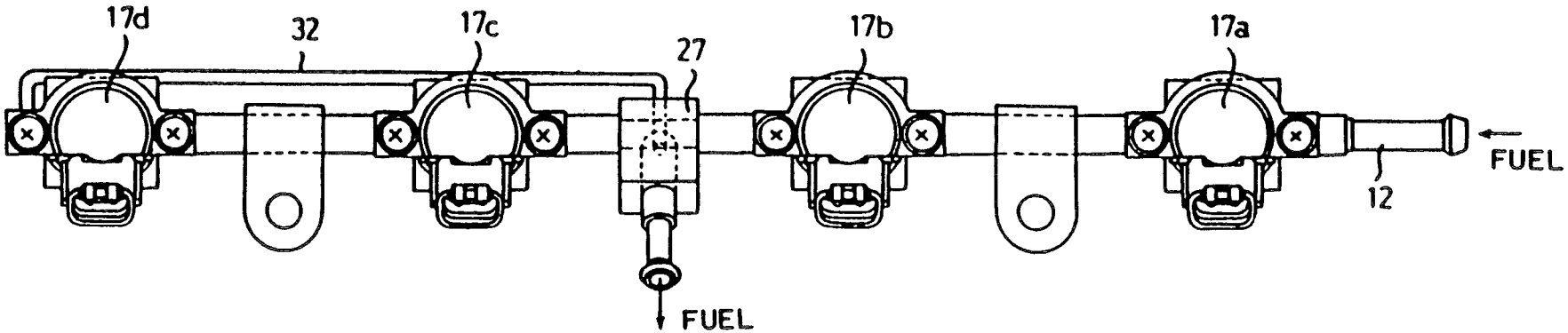
FIG. 30 is a plan view showing a modification of the fourth embodiment.
Figure 31:
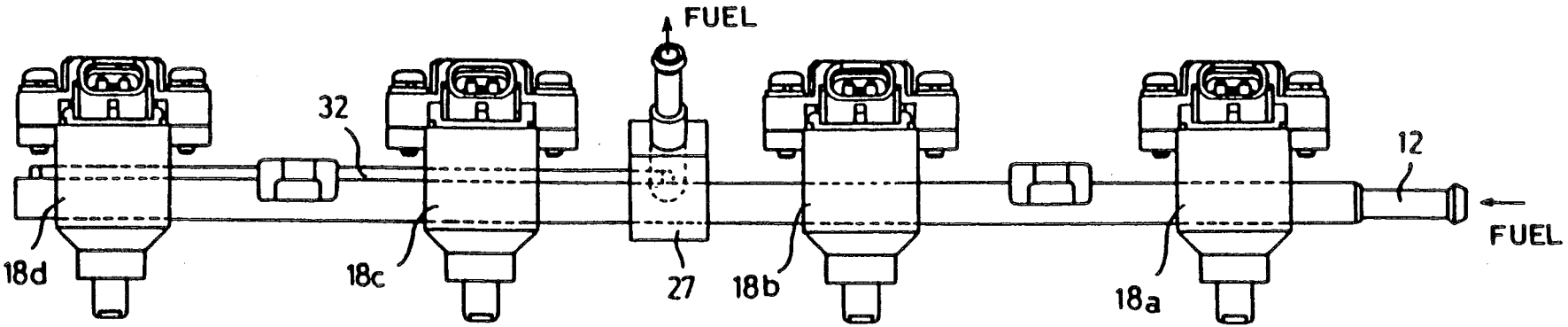
FIG. 31 is front view showing modification of the fourth embodiment.

This embodiment can be applied to a serial four cylinder engine as shown in FIGS. 30 and 31. In this case, the flow divider 27 is provided between two groups of two cylinders each, and the vapor pipe 32 is connected to the downstream end of the flow divider 27.

A fifth embodiment according to a fifth feature of the present invention will be described.

Figure 32:
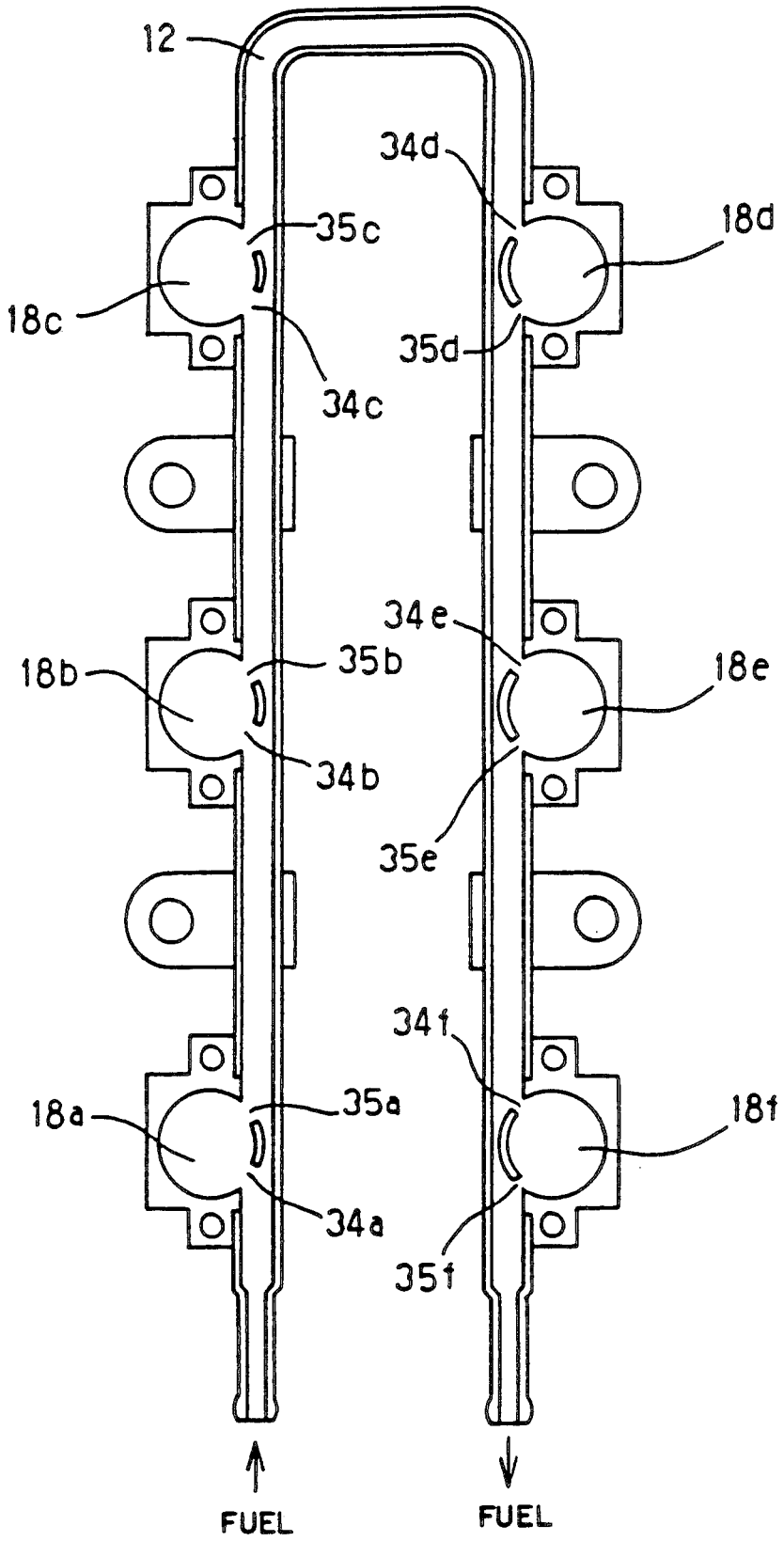
FIG. 32 is plan view of a fifth embodiment.

FIG. 32 shows the fifth embodiment of the fuel supply device used in a V-type six cylinder engine. In FIG. 32, parts identical with those shown in FIGS. 1 to 5 are designated by the same reference numerals, with their description omitted.

To supply the fuel sent through the fuel pipe 12 to the individual fuel injection valves 17*a* t 17*f*, fuel inflow passages 34*a* to 34*f* are formed in the holder portions 18*a* to 18*f* for the cylinders such that the passages 34*a* to 34*c* of the holder portions 18*a* to 18*c* of the upstream section are wide and the passages 34*d* to 34*f* of the holder portions 18*d* to 18*f* of the downstream section are narrow. Similarly, fuel outflow passages 35*a* to 35*f* for discharging of fuel from the holder portions 18*a* to 18*f* are formed such that the passages 35*a* to 35*c* of the upstream section are wide and the passages 35*d* to 35*f* of the downstream section are narrow.

According to the foregoing structure, the fuel sent through the fuel pipe 12 flows into the holder portions 18*a* to 18*c* of the upstream section and flows out of them on a large-quantity basis, whereas the fuel flows into the holder portions 18*d* to 18*f* of the downstream section and flows out of them on a small-quantity bases. Therefore, the fuel injection valves 17*a* to 17*c* of the upstream section are quickly cooled because a large quantity of fuel can flow into the holder portions 18*a* to 18*c* and flow out of them. On the other hand, the fuel injection valves 17*d* to 17*f* of the downstream section can supply the high boiling point component (liquid) of fuel remaining inside the holder portions 18*d* to 18*f* to the engine for a long time.

Figure 33:
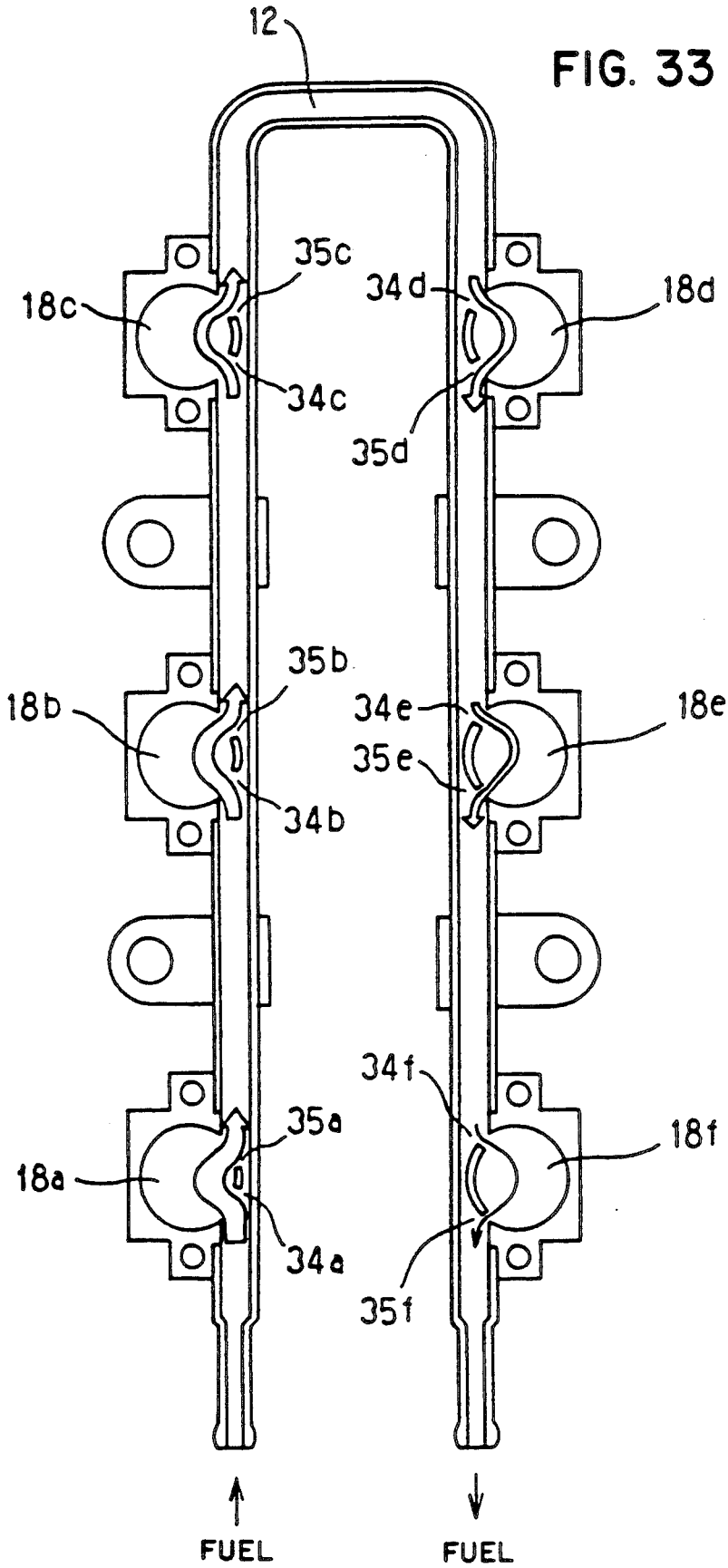
FIG. 33 is plan view showing a modification of the fifth embodiment.

Although this embodiment uses two kinds of size in setting the fuel inflow passage 34*a* to 34*f* and the fuel outflow passages 35*a* to 35*f*, as shown in FIG. 33, the fuel passage may be narrowed from cylinder to cylinder progressively in the flow direction of fuel.

Figure 34:
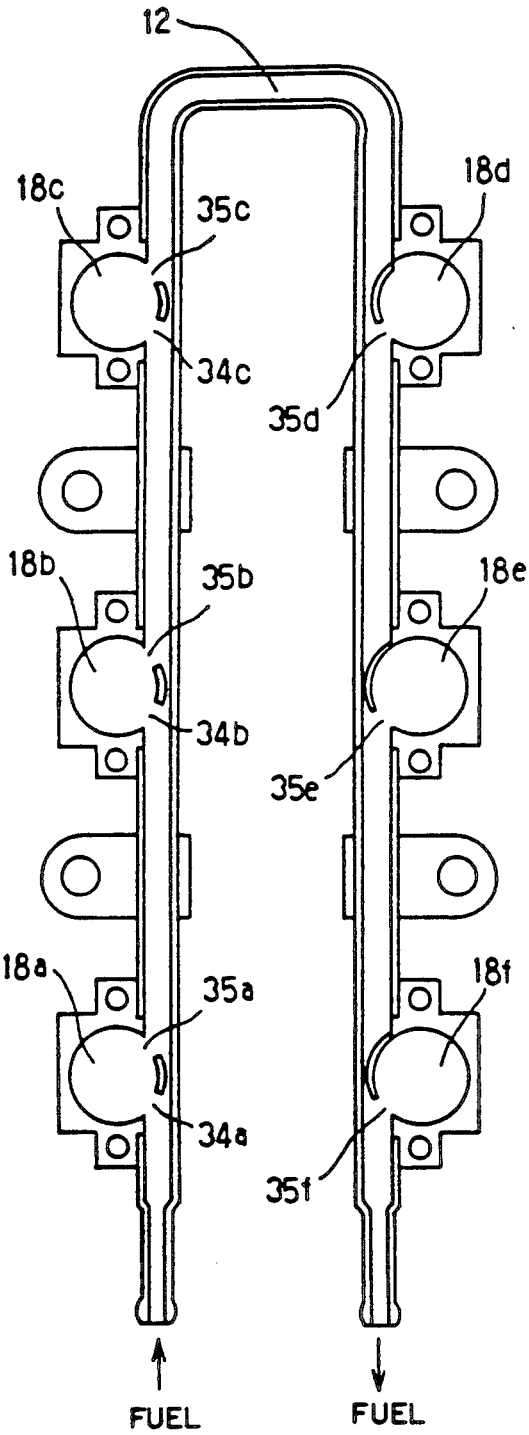
FIG. 34 is a plan view showing another modification of the fifth embodiment.

Further, as shown in FIG. 34, the fuel passages may be modified such that the fuel hardly flows into the holder portions 18*d* to 18*f* the downstream section, or that the fuel outflow passages 35*d* to 35*f* act also as the fuel inflow passages for the purpose of making a large quantity of fuel stay in the holder portions 18*d* to 18*f*.

Figure 35:
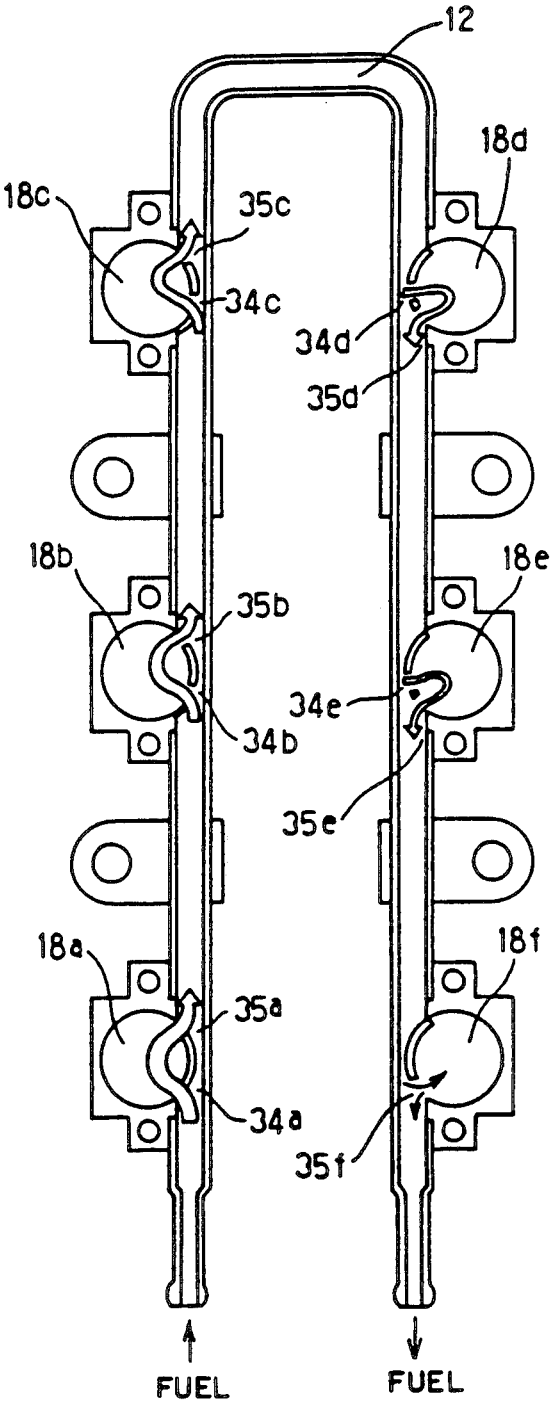
FIG. 35 is a plan view showing another modification of the fifth embodiment.

Further, as shown in FIG. 35, the fuel inflow passages 34*a* to 34*f* may be formed at respective positions where the flowing of the fuel through them becomes difficult from cylinder to cylinder progressively in the flow direction of fuel for the purpose of progressively limiting the flowing of the fuel into the holder portions 18*a* to 18*f*.

A sixth embodiment according to a sixth feature of the present invention will be described.

Figure 36:
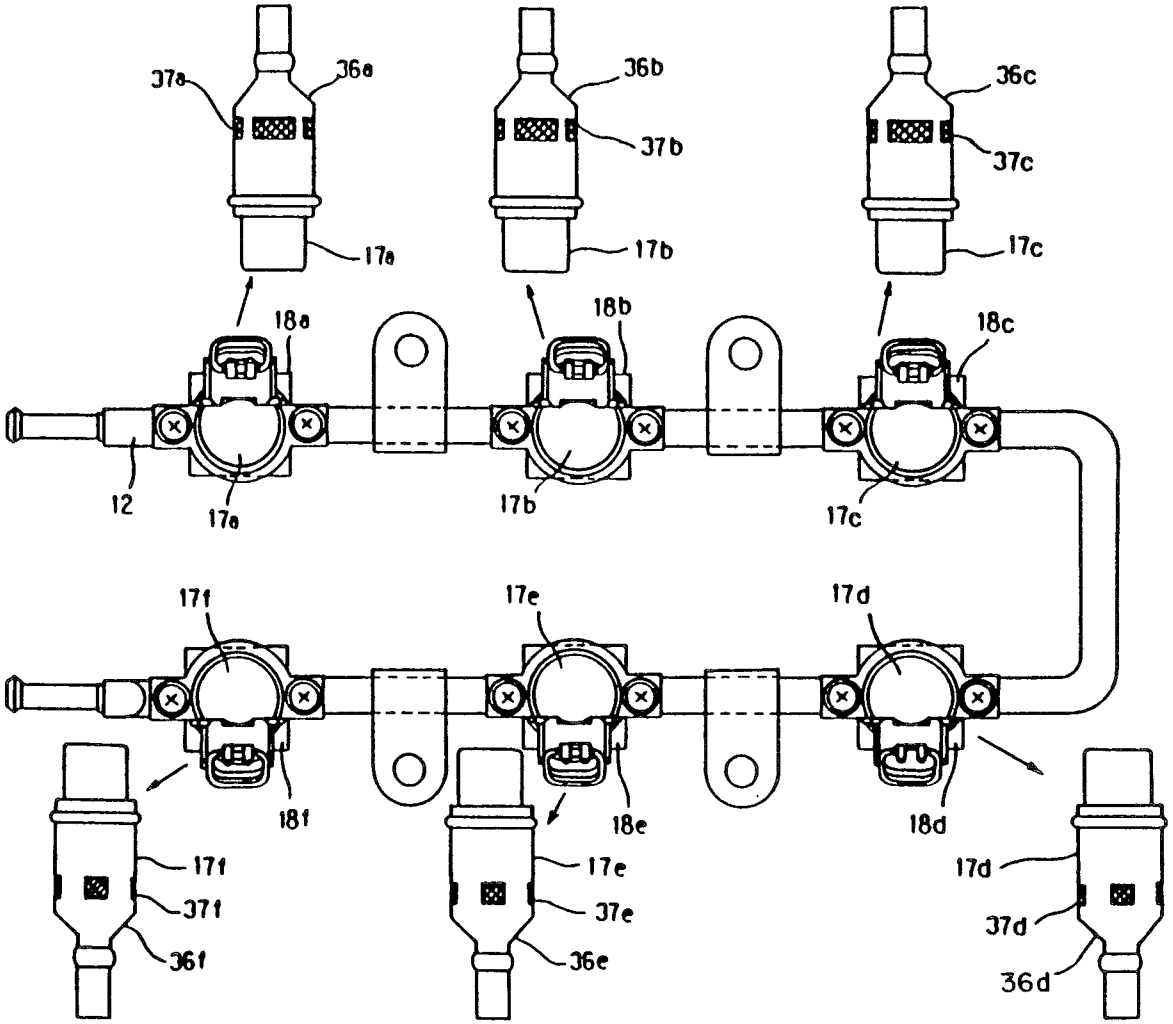
FIG. 36 is a plan view showing a sixth embodiment with a fuel injection valve in side view.
Figure 38:
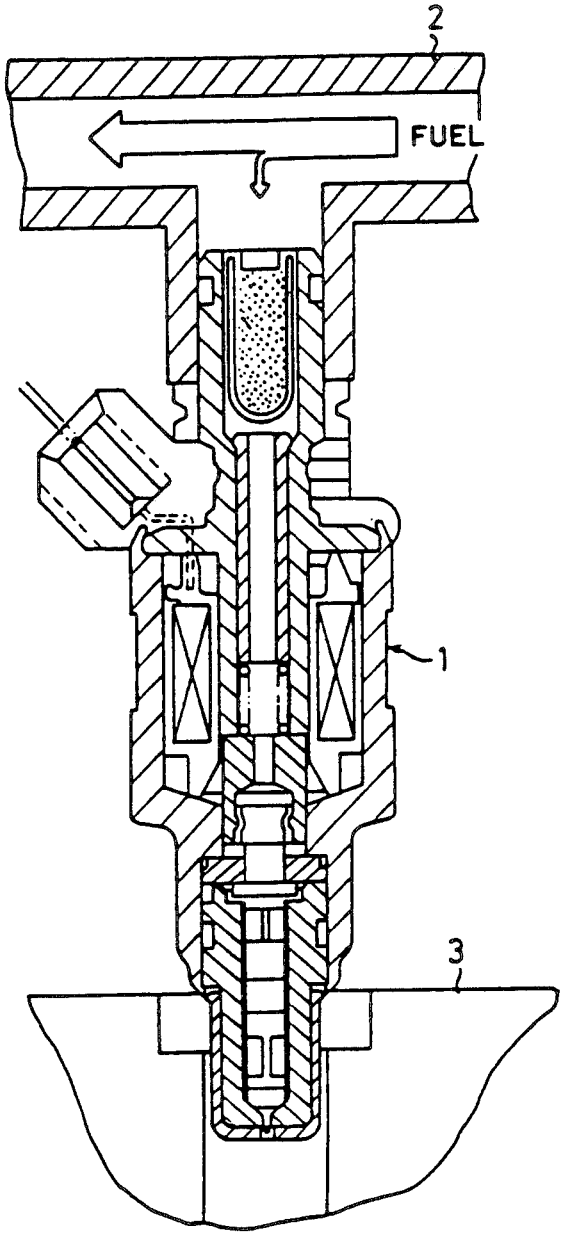
FIG. 38 is a sectional view of a conventional fuel supply device.
Figure 37:
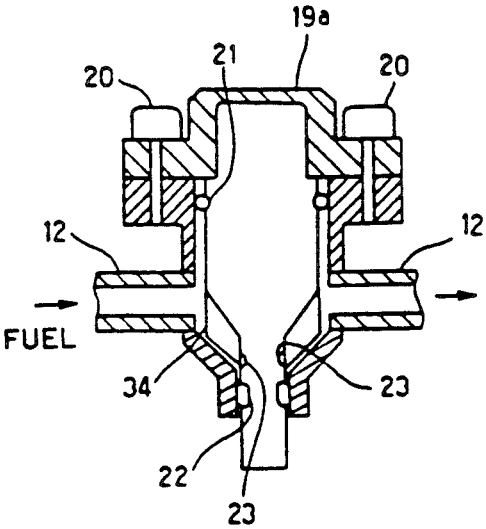
FIG. 37 is a fragmentary sectional view of a sixth embodiment.
Figure 39:
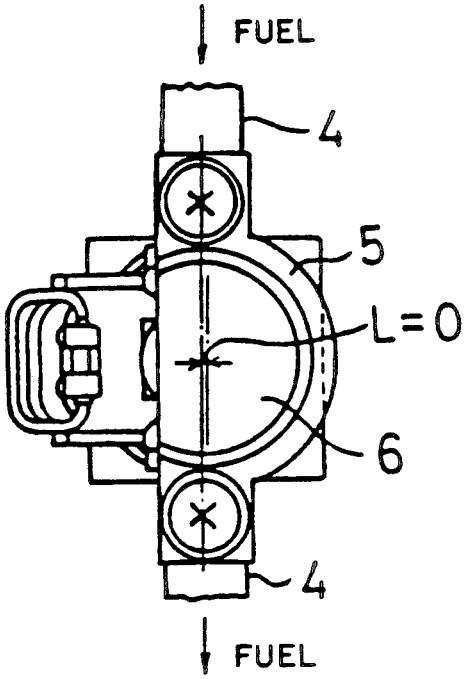
FIG. 39 is a plan view of a conventional fuel supply device.
Figure 41:
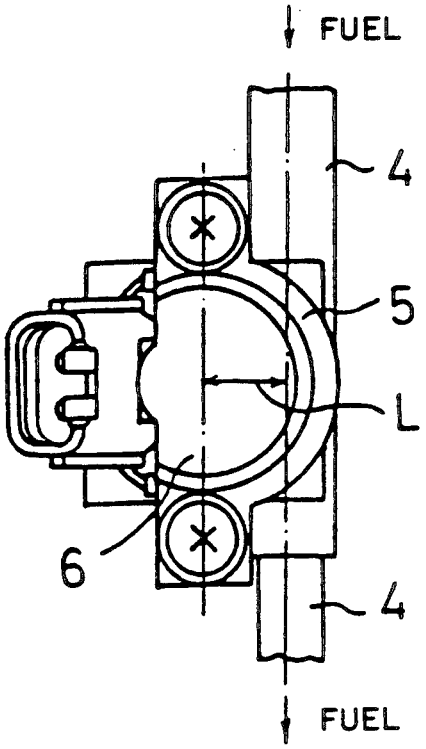
FIG. 41 is another plan view of a conventional fuel supply device.
Figure 40:
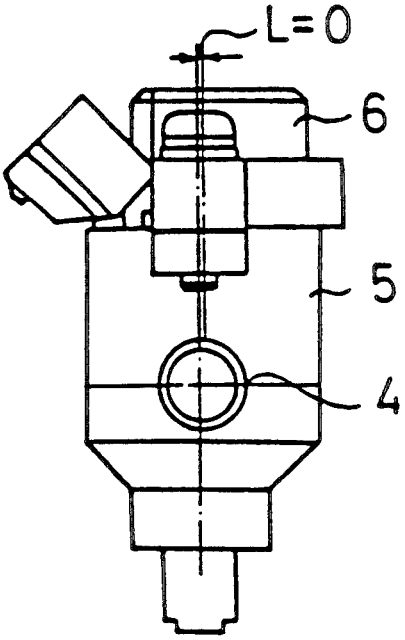
FIG. 40 is a front view of a conventional fuel supply device.
Figure 42:
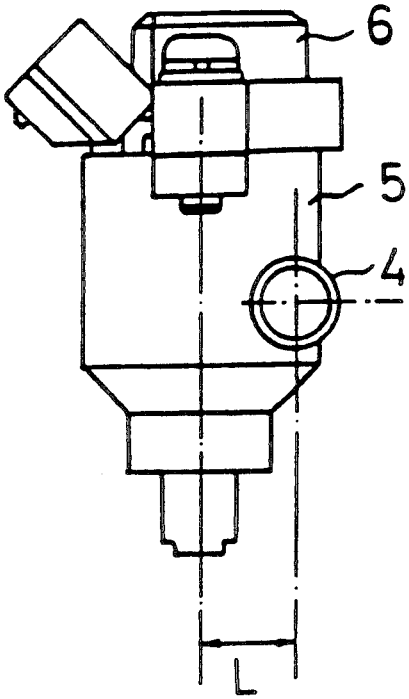
FIG. 42 is another front view of a conventional fuel supply device.

FIGS. 36 and 37 show the sixth embodiment of the fuel supply device used in a V-type six cylinder engine. In these drawings, parts identical with those shown in FIGS. 1 to 5 are designated by the same reference numerals, with their description omitted.

Each of the fuel injection valves 17*a* to 17*f* is provided with a cover-shaped fuel supply portion (36*a* to 36*f*) for introducing fuel into the fuel injection valve, and each fuel supply portion (36*a* to 36*f*) is formed with an opening to which a filter (37*a* to 37*f*) is attached. The opening is set such that the opening area of each of the fuel injection valves 17*a* to 17*c* of the upstream section is large and the opening area of each of the fuel injection valves 17*d* to 17*f* of the downstream section is small.

According to the foregoing structure, a large quantity of fuel is supplied through the fuel pipe 12 to the fuel injection valves 17*a* to 17*c* of the upstream section, but not to the fuel injection valves 17*d* to 17*f* of the downstream section. Therefore, the fuel injection valves 17*a* to 17*c* of the upstream section are quickly cooled by a large supply of fuel, whereas the fuel injection valves 17*d* to 17*f* of the downstream section can supply the high boiling point component (liquid) of fuel remaining inside the fuel supply portions 36*d* to 36*f* to the engine for a long time.

Although this embodiment uses two kinds of size in setting the area of each opening, the opening size may be set such that each opening has a smaller opening area than one on the upstream side or has a larger opening area than one on the downstream side.

What is claimed is:

1. A fuel supplying device for an internal combustion engine having multiple cylinder comprising:

a plurality of fuel injection valves for injecting fuel toward said cylinder;

a fuel pipe through which the fuel flows; and a plurality of holder means mounted on said fuel pipe so that the fuel from said fuel pipe is supplied to said holder means, said holder means accommodating said fuel injection valve so that the fuel is supplied to said fuel injection valve;

wherein a start timing if the fuel supplied from said fuel pipe to at least one of said holder means is different from the start timing of the fuel supplied from said fuel pipe to remaining holder means.

2. A fuel supplying device for an internal combustion engine having multiple cylinder comprising:

a plurality of fuel injection valves for injecting fuel toward said cylinder;

a fuel pipe through which the fuel flows; and a plurality of holder means mounted on said fuel pipe so that the fuel from said fuel pipe is supplied to said holder means, said holder means accommodating said fuel injection valve so that the fuel is supplied to said fuel injection valve;

wherein a distance between a center of at least one of said holder means and a center of said fuel pipe is different from a distance between a center of remaining holder means and a center of said fuel pipe.

3. A fuel supplying device according to claim 2, wherein a distance between a center of half of said holder means and a center of said fuel pipe is different from a distance between a center of remaining half of said holder means and a center of said fuel pipe.

4. A fuel supplying device according to claim 2, wherein a distance between a center of each of said holder means and said fuel pipe is different from a distance between a center of remaining holder means and said fuel pipe.

5. A fuel supplying device for an internal combustion engine having multiple cylinder comprising:

a plurality of fuel injection valves for injecting the fuel toward said cylinder;

a fuel pipe through which fuel flows; and a plurality of holder means mounted on said fuel pipe for accommodating said fuel injection valve, said holder means having a fuel inlet through which the fuel from said fuel pipe is introduced, and an effective area of said fuel inlet of at least one of said holder means is different from the effective area of said fuel inlet of remaining holder means.

6. A fuel supplying device for an intenal combustion engine having multiple cylinder comprising:

a plurality for fuel injection valves for injecting fuel toward said cylinder;

a fuel pipe through which fuel flows;

a plurality of holder means mounted on said fuel pipe so that the fuel from said fuel pipe is supplied to said holder means, said holder means accommodating said fuel injection valve so that the fuel is supplied to said fuel injection valve; and delaying means for delaying a start timing of the fuel supplied from said fuel pipe to at least one of said holder means from the start timing of the fuel supplied from said fuel pipe to remaining holder means.

* * * * *